United States Patent [19]

Barnes

[11] 4,036,562

[45] July 19, 1977

[54] FOOD DEHYDRATOR AND FAN THEREFOR

[76] Inventor: Jack H. Barnes, Kellogg Star Rte., Box 100, Oakland, Oreg. 97462

[21] Appl. No.: 591,617

[22] Filed: June 30, 1975

[51] Int. Cl.[2] ..... F04D 29/32

[52] U.S. Cl. ..... 415/79; 34/196

[58] Field of Search ..... 34/219, 225, 226, 231, 34/233, 196, 197; 126/21 A; 415/79; 416/193, DIG. 5

[56] References Cited

U.S. PATENT DOCUMENTS

| | | | |
|---|---|---|---|
| 1,377,827 | 5/1921 | Garela | 415/79 |
| 1,462,151 | 7/1923 | Seymour | 415/79 |
| 1,991,194 | 2/1935 | Child | 415/79 |
| 2,017,728 | 10/1935 | Oskamp | 34/196 |

FOREIGN PATENT DOCUMENTS

| | | | |
|---|---|---|---|
| 776,418 | 1/1935 | France | 415/79 |
| 2,030,238 | 12/1971 | Germany | 416/193 |

*Primary Examiner*—Kenneth W. Sprague
*Assistant Examiner*—James C. Yeung
*Attorney, Agent, or Firm*—James D. Givnan, Jr.

[57] ABSTRACT

A dehydrator for the drying of small articles including a cabinet having a series of vertically spaced trays offset from a relatively large diameter fan blade structure. The fan blade structure drives air through a first airflow zone of cylindrical configuration while a second airflow zone, located interiorly of the first zone, is occupied by an airflow opposite in direction to the first airflow and induced by a negative pressure area rearward of the fan blade. The negative pressure area is communicated to the dryer by means of the fan blade's apertured central area. Said negative pressure area rearward of the fan blade receives a flow of air through the fan blade which flow is recirculated past a heat source whereupon the fan vanes again drive the air past the articles being dried. A modified form of fan blade structure incorporates vane components located in the central area of the blade to assist in air recirculation.

3 Claims, 5 Drawing Figures

FOOD DEHYDRATOR AND FAN THEREFOR

BACKGROUND OF THE INVENTION

The present invention relates to a food dehydrator and more particularly to one of the general type shown and described in my earlier filed U.S. patent application accorded Ser. No. 538,098 abandoned. A different fan arrangement is presently disclosed along with differences in the dehydrator itself.

Food dehydrators or dryers used within the home are desirably of a compact nature, incorporating a heat source and a fan for circulating heated air past the food articles. A current problem in small dryers, as used in the home, is providing an adequate airflow over the articles being dried to accomplish dehydration in the shortest period. Current dryers for home use are of a large, cumbersome nature by reason of not efficiently utilizing their drying chamber and hence do not lend themselves to convenient storage. Further, from the standpoint of energy conservation, they cannot be considered efficient.

SUMMARY OF THE INVENTION

The present invention concerns a food dehydrator and a fan blade structure for use therein providing axially orientated discharge and return flows to propel air past the articles being dried.

The present fan blade structure, in one form, is characterized by a series of vanes disposed adjacent the blade perimeter with an inner blade area being perforate to permit passage of a return flow through the blade. The fan blade is of a diameter only somewhat less than the dryer cross sectional dimension to drive a continuous flow of air through a first zone while the perforate central area of the fan permits air to move through a central zone of the dryer and through the fan blade for recirculation past a heat source. While the zones are not precisely defined, it is believed accurate to say that a first zone is generally cylindrical and offset from the fan vanes while a second zone is located within said first cylindrical zone with air movement in the two zones being substantially in opposite directions. That area rearward of the fan structure is of lower air pressure and, in effect, draws return air through the perforate blade.

A modified form of fan structure, in addition to having a relieved central portion for the passage of return air, further incorporates blade components of a pitch opposite to the pitch of the outer vanes. Such a fan blade contributes toward circulation by assisting the return flow in a positive manner.

Important objects of the present invention include the provision of: a dehydrator and fan combination wherein a fan blade both drives air past the food articles while permitting air return through the blade for recirculation past a heat source; a fan blade which permits the dryer to be constructed without partitioned air passageways thus enabling the entire internal area of the dryer to be devoted to food racks; a fan blade which may be economically formed from light weight material contributing to a low manufacturing cost; a fan blade having inner and outer vanes of opposite pitch to drive air outwardly through a first zone and subsequently return air via a central zone.

DESCRIPTION OF THE PREFERRED EMBODIMENTS

Figure 1:
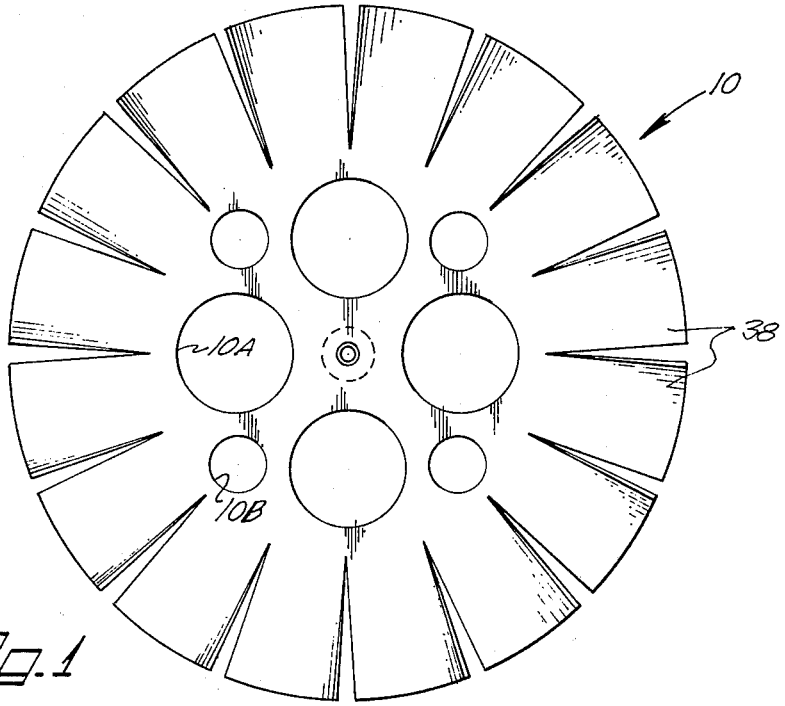
FIG. 1 is an elevational view of a fan blade structure.

With continuing reference to the accompanying drawing wherein applied reference numerals indicate parts similarly identified in the following specification, the reference numeral 10 indicates generally a fan blade structure for incorporation into a dryer cabinet indicated generally at 11 such being of the type used for drying food in the home.

The dryer cabinet includes sidewalls 12, top and bottom walls 13 and 14 and a rear wall 15. The forward end of the cabinet is closed by a door 16 mounted by suitable hinges at 17.

The cabinet internally defines a drying chamber 19 forwardly of fan 10 in which trays 18, bearing food articles to be dried, are temporarily stored. Runners 20 slidably support each of the dehydrator trays. A stop 21 limits the inserted travel of each tray. A fan shroud at 22 defines a circular opening 22A closely adjacent the periphery of blade structure 10. For purposes of assisting the recirculation of air within the dryer, pairs of upper and lower air deflectors 24 and 25 are provided which provide inclined surfaces for redirecting air with reduced turbulence.

A heating element at 26 is retained in place away from wall 15 of the dryer by means of insulated supports 27. Said heating element is of quadrilateral configuration to efficiently heat recirculated air as well as air entering the cabinet via screened intakes 28. A settable thermostat 30 is in circuit with the heating element and with a source via a switch 31. For regulating the exhaust of dryer air, and hence the intake of ambient air into the dryer cabinet, I provide an adjustable cover plate 35 on front wall 16 which plate overlies the screened opening 36. A probe type thermometer 37 is also mounted on the front wall.

Figure 2:
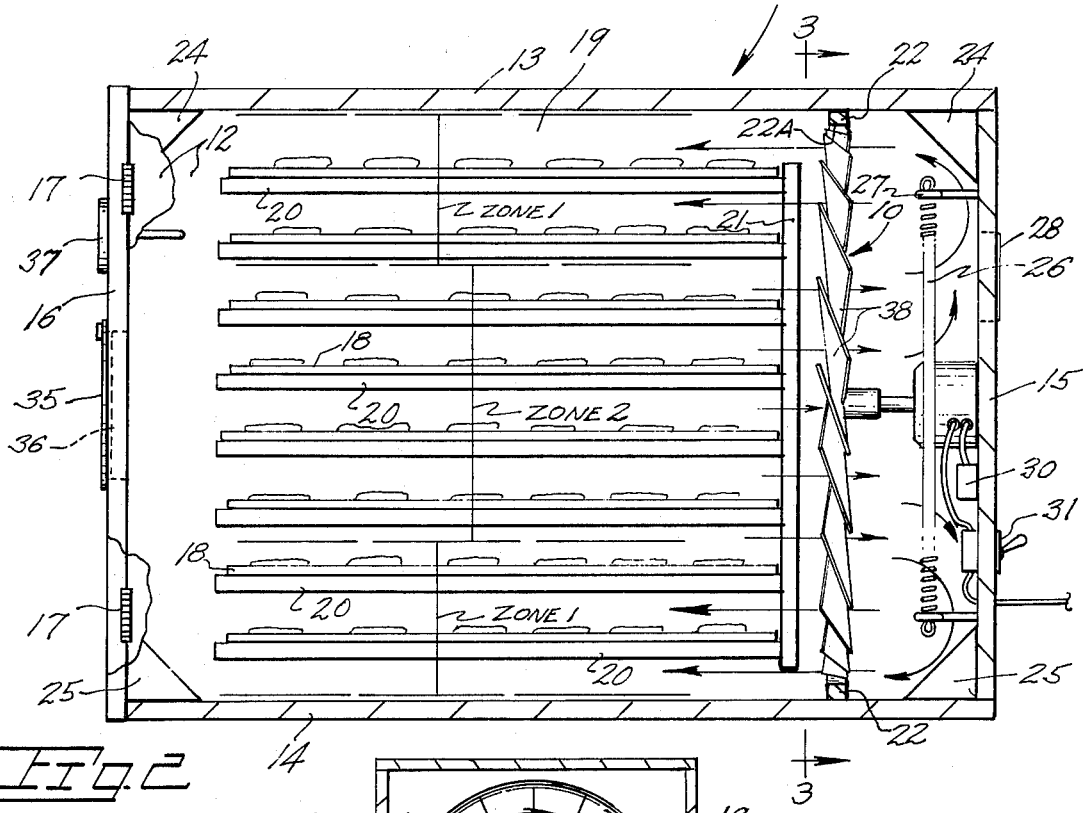
FIG. 2 is a side elevational view of a food dehydrator cabinet with a sidewall thereof removed.
Figure 3:
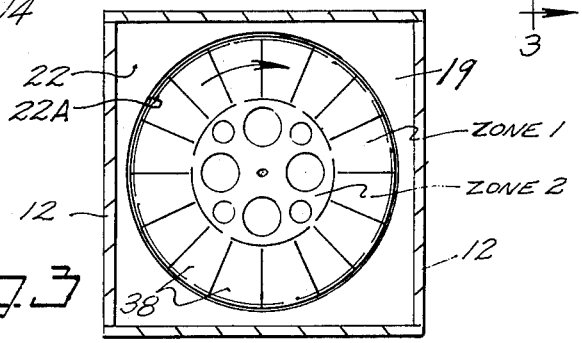
FIG. 3 is a vertical section taken along line 3—3 of FIG. 2 showing airflow zones.

With attention to FIG. 2, wherein a sidewall 12 has been substantially removed, it will be seen that trays 18 are evenly and compactly spaced from top to bottom to fully utilize drying chamber 19 with no space being devoted to return air passageways. To affect a desired circulation airflow within the dryer chamber, blade 10 provides both for driving a flow of air through a first zone indicated as zone 1 which may be said to be of cylindrical configuration as viewed in section in FIG. 3. For returning air to the negative pressure side or that area rearward of the fan blade in which heating element 26 is located, said blade is provided with open areas 10A and 10B located inwardly from the blade vanes at 38. The central area of the fan is accordingly of a perforate nature enabling communication of the negative pressure area rearward of fan blade 10 to the drying chamber area forward of the blade to thereby affect an axial flow of air towards the blade through a second zone indicated as zone 2. Accordingly, air returning towards the blade dries food articles on those trays within zone 2 in distinction to prior art dryers wherein return air was necessarily routed away from the articles being dried via ducts or passageways. The present fan blade permits the full interior area of a drying cabinet to be utilized for the reception of food trays enabling drying of a quantity of food to be more rapidly accomplished than with prior dryer cabinet structures.

Figure 4:
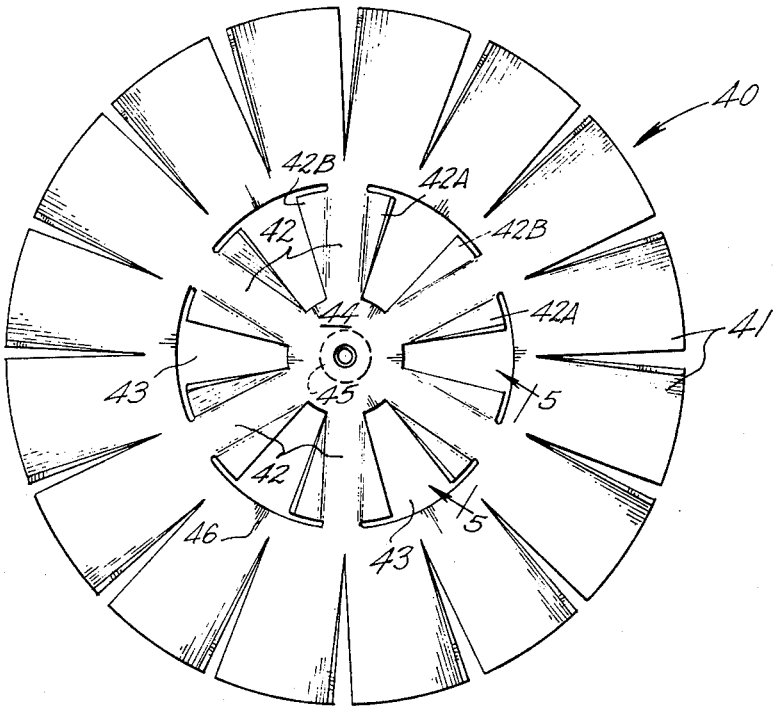
FIG. 4 is a view similar to FIG. 1 of a modified blade structure.
Figure 5:
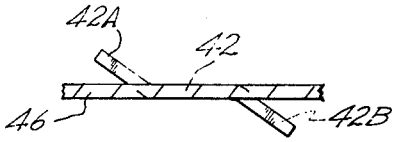
FIG. 5 is a sectional view taken along line 5—5 of FIG. 4 showing blade details.

Disclosed in FIGS. 4 and 5 is a fan blade structure indicated generally at 40 including an outer series of vanes 41 constituting the peripheral portion of the blade similar to the blade arrangement shown in FIG. 1. A central portion of the blade, integral wih said vanes, provides an inner series of vanes 42. Each of the vanes 42 includes leading and trailing vane edge components 42A and 42B each pitched outwardly in opposite directions from a common planar portion therebetween so as to drive recirculating air in a direction opposite to the flow of air resulting from the outer series of vanes 41. Open areas 43 are intermediate each of the vanes 42. A central hub portion 44 mounts a boss 45 on its unseen side. An annular blade area 46 is intermediate the inner and outer vanes. In similarity to the first described blade structure air passes through the perforations 43 of the blade with vanes 42 contributing towards such an airflow. Said blade 40 may be incorporated into a dryer cabinet and when done so would provide generally the same airflow patterns through the zones earlier described.

For economy of manufacture the blade is preferably formed from a unitary piece of light weight sheet stock such as aluminum stock. The motor M powering the fan need only be of fractional horsepower by reason of the fan blade being of light weight.

While I have shown but a few embodiments of the invention it will be apparent to those skilled in the art that the invention may be embodied still otherwise without departing from the spirit and scope of the invention.

Having thus described the invention what is desired to be secured under a Letters Patent is:

1. A circular fan blade formed from a single sheet of lightweight material for moving air in opposite directions past articles being dried in a food dryer, said blade comprising, an outer series of vanes comprising the peripheral portion of the blade, said vanes having substantially radial leading and trailing edges and being of a pitch to propel an airflow in one direction, an annular planar blade area inwardly of said vanes, an inner series of vanes formed from said single sheet of material inwardly of said planar blade area with each inner vane having leading and trailing edge components and being of a pitch opposite to the pitch of each outer vane, said inner vanes adapted to propel an airflow in a direction opposite to the airflow discharged by the outer series of vanes, and a central planar hub portion coplanar with said annular blade area and adapted to receive the shaft of a power source.

2. The fan blade claimed in claim 1 wherein each of said inner vanes additionally includes a radially disposed planar portion perpendicularly orientated to the axis of fan rotation and extending intermediate the hub portion and the annular blade area.

3. The fan blade claimed in claim 2 wherein the leading and trailing edge components project in opposite directions from said common radially disposed planar portion.

* * * * *